US008894059B2

(12) United States Patent
Yoshida

(10) Patent No.: US 8,894,059 B2
(45) Date of Patent: Nov. 25, 2014

(54) SHEET FEEDING DEVICE AND IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/928,192

(22) Filed: Jun. 26, 2013

(65) Prior Publication Data

US 2014/0001696 A1 Jan. 2, 2014

(30) Foreign Application Priority Data

Jun. 28, 2012 (JP) ..... 2012-144843

(51) Int. Cl.
*G03G 21/16* (2006.01)
*B65H 5/00* (2006.01)

(52) U.S. Cl.
CPC . *B65H 5/00* (2013.01); *G03G 21/16* (2013.01)
USPC ..... 271/9.01; 271/9.11; 271/145; 399/110; 399/107; 399/393; 399/391

(58) Field of Classification Search
CPC ..... G03G 21/16
USPC ..... 271/9.01, 9.11, 145; 399/107, 110, 393, 399/391
See application file for complete search history.

(56) References Cited

U.S. PATENT DOCUMENTS 5,666,595 A * 9/1997 Sameshima et al. ..... 399/110
7,203,445 B2 * 4/2007 Uchida ..... 399/107
2005/0196192 A1 9/2005 Morimoto et al.
2005/0208843 A1 9/2005 Kobayashi
2013/0050382 A1 * 2/2013 Okamoto ..... 347/108
2013/0195503 A1 * 8/2013 Nakagaki ..... 399/107

FOREIGN PATENT DOCUMENTS

JP H02-204231 A 8/1990
JP H03-37449 U 4/1991
JP H03-043655 U 4/1991

(Continued)

OTHER PUBLICATIONS

An Office Action; "Notice of Reason for Rejection," issued by the Japanese Patent Office on Sep. 2, 2014, which corresponds to Japanese Patent Application No. 2012-144843 and is related to U.S. Appl. No. 13/928,192.

*Primary Examiner* — Luis A Gonzalez
(74) *Attorney, Agent, or Firm* — Studebaker & Brackett PC

(57) ABSTRACT

A sheet feeding device comprises a structure as an option, on which an apparatus main body of an image forming apparatus having a lower face with a positioning depression is placed. The structure includes a mounting member, a reinforcement member and a positioning pin. The mounting member is located to face to a periphery of the lower face. The reinforcement member is located below the mounting member. The positioning pin includes an upper part having a guard part and a lower part. The pin penetrates the mounting member so that the upper part can fit in the positioning depression and the lower part can come into contact with the reinforcement member. When the apparatus main body is placed, the upper part fits in the positioning depression, the guard part comes into contact with an edge of the positioning depression and the lower part comes into contact with the reinforcement member.

8 Claims, 12 Drawing Sheets

(56) References Cited

FOREIGN PATENT DOCUMENTS

| | | | | |
|---|---|---|---|---|
| JP | H03-44129 | U | | 4/1991 |
| JP | H03-114065 | A | | 5/1991 |
| JP | 05-077943 | A | | 3/1993 |
| JP | H08-262825 | A | | 10/1996 |
| JP | H09-166951 | A | | 6/1997 |
| JP | 2001-199567 | A | | 7/2001 |
| JP | 2006-350084 | A | | 12/2006 |
| JP | 2009157147 | A | * | 7/2009 |
| JP | 2009-236938 | A | | 10/2009 |

* cited by examiner

SHEET FEEDING DEVICE AND IMAGE FORMING APPARATUS

INCORPORATION BY REFERENCE

This application is based on and claims the benefit of priority from Japanese Patent application No. 2012-144843 filed on Jun. 28, 2012, the entire contents of which are incorporated herein by reference.

BACKGROUND

The present disclosure relates to a sheet feeding device as an option, which can be added below an apparatus main body, and an image forming apparatus provided with the sheet feeding device.

An image forming apparatus, such as a copying machine, a printer or a multifunction machine is well-known to install a sheet feeding cartridge storing sheets in a main body (an apparatus main body) of the image forming apparatus. Because the sheet feeding cartridge restricts a type and number of the sheets to be stored, there is the image forming apparatus of a type that can optionally add a sheet feeding device including the sheet feeding cartridge below the apparatus main body.

However, in this type of the image forming apparatus, when the apparatus main body is placed on the sheet feeding device in order to add the sheet feeding device to the apparatus main body, if reciprocal positioning accuracy is decreased, it is fear of causing failure of electrical connection or driving connection, or skew conveyance or a catch of the sheet. In addition, when the apparatus main body is placed on the upper surface of the sheet feeding device, it is fear of causing a problem that a bend is caused to a frame of the sheet feeding device to decrease the positioning accuracy.

Then, in the image forming apparatus generally known in order to solve the above-mentioned problem, one of a cartridge guide of the apparatus main body and a cartridge guide of the sheet feeding device is provided with a positioning protrusion for positioning both the cartridge guides to each other and the other is provided with a positioning depression engaged with the positioning protrusion. This image forming apparatus intends to improve the positioning accuracy of the image forming apparatus and sheet feeding device and to prevent the conveyance failure of the sheet.

However, the above-mentioned image forming apparatus includes the positioning protrusion and positioning depression in the respective cartridge guides of the apparatus main body and sheet feeding device. Therefore, when the apparatus main body is placed on the upper surface of the sheet feeding device, if impact is added to the positioning protrusion or the positioning depression, it is fear that the cartridge guides are damaged to exert a bad influence on a conveyance performance.

Moreover, another generally known image forming apparatus divides a supporting face of the sheet feeding device for supporting the apparatus main body into two parts to purpose decreasing a load to the supporting face part at an ejecting opening side of the sheet feeding device among two supporting face parts.

However, although the above-mentioned image forming apparatus has a means of decreasing a weight load of the apparatus main body to the supporting face part at the ejecting opening side of the sheet feeding device, in the apparatus main body, mechanism members, such as a transferring unit and a fixing unit, are gathered at the ejecting opening side. Therefore, it is difficult to decrease the weight load of the apparatus main body.

SUMMARY

In accordance with an embodiment of the present disclosure, a sheet feeding device includes a structure as an option, on which an apparatus main body of an image forming apparatus having a lower face with a positioning depression is placed. The structure includes a mounting member, a reinforcement member and a positioning pin. The mounting member is located to face to a periphery of the lower face of the apparatus main body. The reinforcement member is located below the mounting member. The positioning pin is configured to include an upper part having a guard part and a lower part. The positioning pin is also configured to penetrate the mounting member so that the upper part can fit in the positioning depression and the lower part can come into contact with the reinforcement member. When the apparatus main body is placed, in the positioning pin, the upper part fits in the positioning depression, the guard part comes into contact with an edge of the positioning depression and the lower part comes into contact with the reinforcement member.

In accordance with an embodiment of the present disclosure, an image forming apparatus includes an apparatus main body having a lower face with a positioning depression and a sheet feeding device as an option on which the apparatus main body is placed. The sheet feeding device includes a mounting member, a reinforcement member and a positioning pin. The mounting member is located to face to a periphery of the lower face of the apparatus main body. The reinforcement member is located below the mounting member. The positioning pin is configured to include an upper part having a guard part and a lower part. The positioning pin is also configured to penetrate the mounting member so that the upper part can fit in the positioning depression and the lower part can come into contact with the reinforcement member. When the apparatus main body is placed, in the positioning pin, the upper part fits in the positioning depression, the guard part comes into contact with an edge of the positioning depression and the lower part comes into contact with the reinforcement member.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 7A shows a condition before the apparatus main body is placed on the sheet feeding device and FIG. 7B shows another condition after the apparatus main body is placed on the sheet feeding device.

FIG. 8A is a side view partially showing the sheet feeding device around the positioning pin and FIG. 8B is an exploded perspective view partially showing the sheet feeding device around the positioning pin.

FIG. 9A is a side view partially showing the sheet feeding device around the positioning pin and FIG. 9B is an exploded perspective view partially showing the sheet feeding device around the positioning pin.

FIG. 9A is a side view partially showing the sheet feeding device around the positioning pin and FIG. 9B is an exploded perspective view partially showing the sheet feeding device around the positioning pin.

Figure 1:
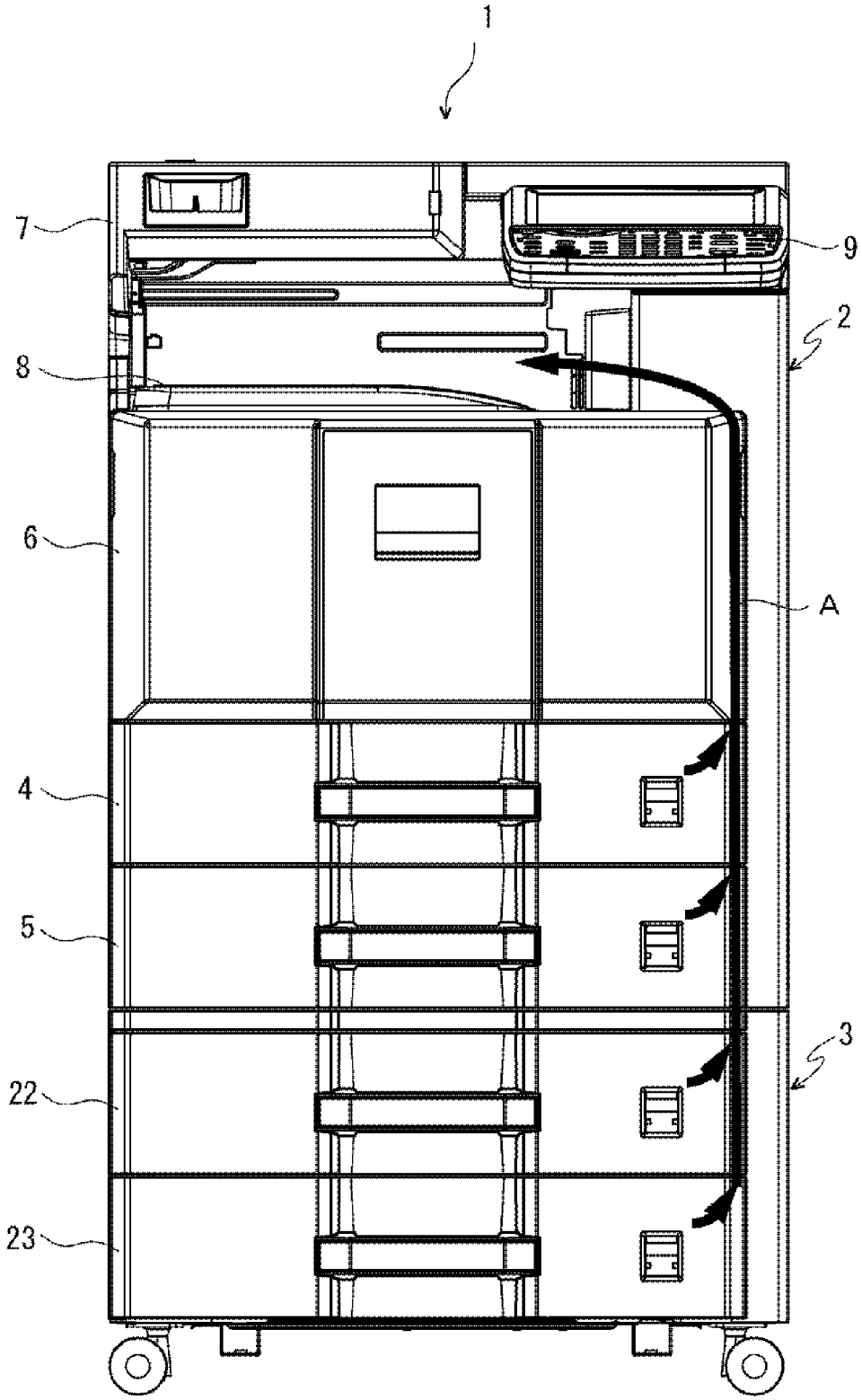
FIG. 1 is a front view showing an image forming apparatus according to an embodiment of the present disclosure.

DETAILED DESCRIPTION with reference to the drawings, the image forming apparatus according to the embodiment of the present disclosure will be described as follows. In the following description, forward and backward, left and right, and upper and lower directions are indicated by standard in view of a user operating the image forming apparatus.

The image forming apparatus according to the embodiment of the present disclosure is formed in a vertically long rectangular parallelepiped-liked shape and provided with a main body (an apparatus main body) 2 of the image forming apparatus and a sheet feeding device 3 as an option on which the apparatus main body 2 is placed.

The apparatus main body 2 is configured to include two tiered upper and lower sheet feeding cartridges 4 and 5, an image forming unit 6, an image reading unit 7, an ejected sheet tray 8 and an operation panel 9. The sheet feeding cartridges 4 and 5 store a lot of sheets. The image forming unit 6 is located above the sheet feeding cartridges 4 and 5 to form an image on the sheet. The image reading unit 7 is located above the image forming unit 6 to read an image from a document. The ejected sheet tray 8 is located between the image forming unit 6 and image reading unit 7 to hold an image-formed sheet. The operation panel 9 is located at a right forward side of the image reading unit 7.

Figure 2A:
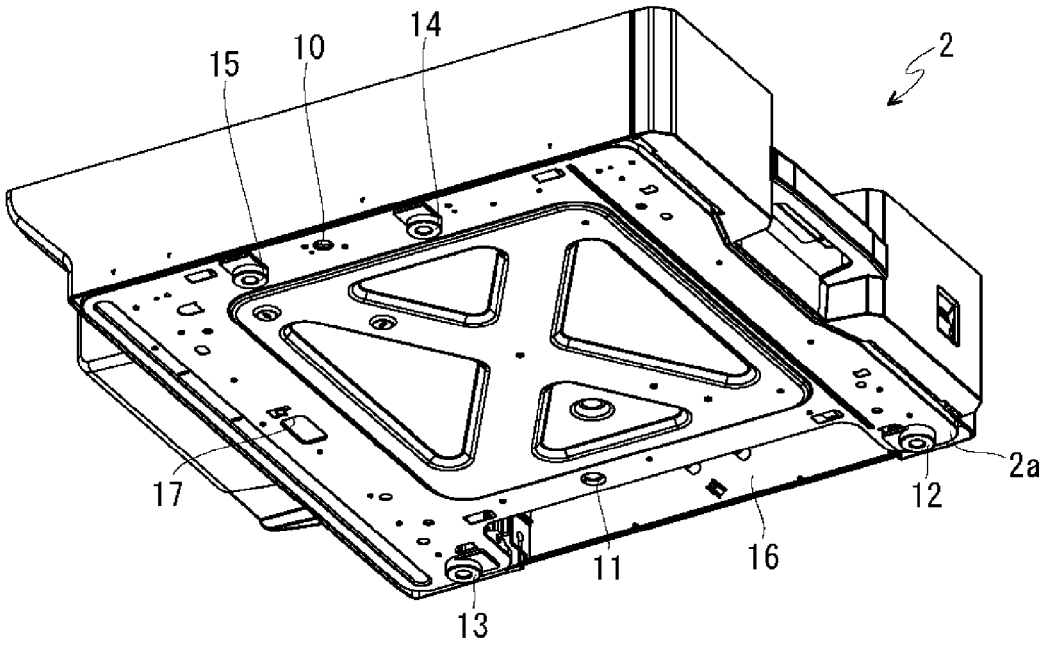
FIG. 2A is a bottom perspective view showing an apparatus main body according to the embodiment of the present disclosure and FIG. 2B is a perspective view showing a stand rubber attached to the apparatus main body of the image forming apparatus according to the embodiment of the present disclosure.

As shown in FIG. 2A, a lower face 2*a* of the apparatus main body 2 is provided with a pair of left and right positioning holes 10 and 11 as positioning depression, and four stand rubbers 12, 13, 14 and 15 as feet. In addition, the lower face 2*a* of the apparatus main body 2 is provided with a conveying port 16 for receiving the sheet conveyed from the sheet feeding device 3 and conveying the sheet along a conveying path A (indicated by thick arrow in FIG. 1) to the inside of the apparatus main body 2 and a female connector 17.

The left positioning hole 10 is located at the roughly center in the forward and backward directions in a left periphery and the right positioning hole 11 is located at the roughly center in the forward and backward directions to the center from the conveying port 16 in a right periphery.

The stand rubbers 12, 13, 14 and 15 are configured to make three point mounting by the stand rubber 12 as a first foot located at a right front corner, the stand rubber 13 as a second foot located at a right back corner and the stand rubbers 14 and 15 as third feet respectively located at forward and backward positions adjacent to the left positioning hole 10.

Figure 2B:
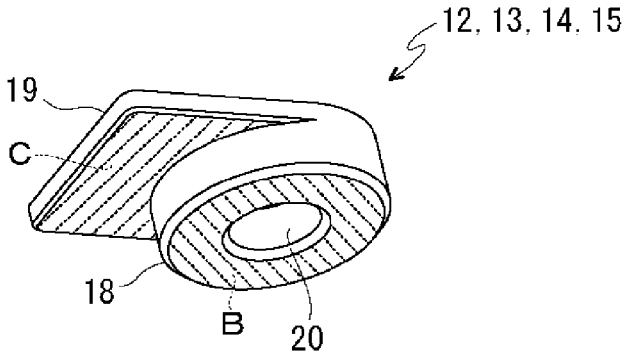

As shown in FIG. 2B, each stand rubber 12, 13, 14, 15 has a flat column part 18 and an eaves-liked thin plate 19 extended from top circumference of the flat column part 18. In a center of a lower face of the column part 18, a columnar depression 20 is formed, and, in a center of a top face of the column part 18, a penetration hole 21 (refer to FIGS. 7A and 7B) is formed in smaller diameter than the depression 20 to communicate with the depression 20. Then, by inserting a fastening element in the penetration hole 21, the stand rubbers 12, 13, 14 and 15 are fixed to the lower face 2*a* of the apparatus main body 2.

The lower face (an area indicated by hatching B in FIG. 2B) of the column part 18 is a contact face when the apparatus main body 2 is placed on a desk or a floor directly and a lower face (another area indicated by hatching C in FIG. 2B) of the thin plate 19 is another contact face when the apparatus main body 2 is placed on the sheet feeding device 3.

The conveying port 16 is opened between the stand rubber 12 at the right front corner and stand rubber 13 at the right back corner in the right periphery and the female connector 17 is located at a roughly center in a backward periphery. In a right lower part of a back face of the apparatus main body 2, a fixing depression 39 is formed (refer to FIG. 12).

Figure 3:
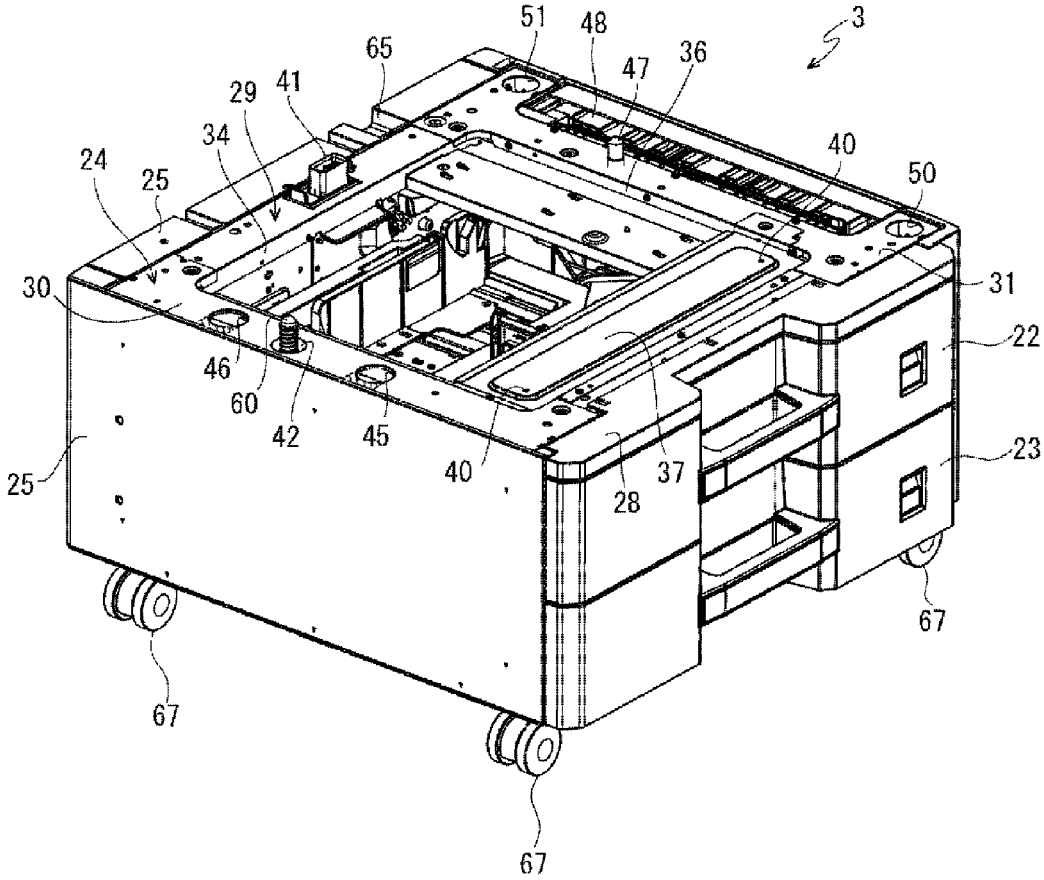
FIG. 3 is a perspective view showing a sheet feeding device of the image forming apparatus according to the embodiment of the present disclosure.

As shown in FIGS. 1 and 3, the sheet feeding device 3 is attachably/detachably installed below the lower sheet feeding cartridge 5 of the apparatus main body 2 as an option separate from the sheet feeding cartridges 4 and 5 of the apparatus main body 2 and includes two tiered upper and lower sheet feeding cartridges 22 and 23. Therefore, the image forming apparatus 1 can store the sheets for four types of sizes (e.g. A4, A3, B4, B5 sheets) by the four tiered sheet feeding cartridges 4, 5, 22 and 23.

The sheet feeding device 3 also includes a frame 24 formed in a rectangular box-liked shape, cover panels 25 attached on left and right sides and the back of the frame 24 and casters 67 rollably attached on four corners of the lower face and allows installation of the sheet feeding cartridges 22 and 23 so that the cartridges can be pulled out forward.

As shown in FIGS. 3 to 6, the frame 24 includes four support poles stood on four corners (a left front support pole 26 and a left back support pole 27 are shown in the figures, but right front and right back support poles are not shown). The frame 24 also includes upper stays as mounting members connecting top ends of the support poles with each other in a rectangular ring form and lower stays connecting bottom ends of the support poles with each other. As the upper stays, a front upper stay 28, a back upper stay 29, a left upper stay 30 and a right upper stay 31 are shown. As the lower stays, a left lower stay 32 is shown, but a front lower stay, a back lower stay and a right lower stay are not shown. Moreover, the frame 24 includes intermediate stays as reinforcement members connecting the support poles with each other between the upper stays and lower stays. As the intermediate stays, a left intermediate stay 33 is shown, but a front intermediate stay, a back intermediate stay and a right intermediate stay are not shown. In addition, the frame 24 includes upper stay reinforcing plates respectively attached to lower face sides of the upper stays 28, 29, 30 and 31. As the upper stay reinforcing plates, a back upper stay reinforcing plate 34, a left upper stay reinforcing plate 35 and a right upper stay reinforcing plate 36 are shown, but a front left upper stay reinforcing plate is not shown. Furthermore, the frame 24 is configured to include a fixing plate 37 attached along back end of the front upper stay 28 between front ends of the left upper stay 30 and right upper stay 31. In left and right sides of the fixing plate 37, screw holes 40 are formed so that fixing screws 38 (refer to FIG. 11) can be screw with the respective holes.

As shown in FIG. 3, on the roughly center of the back upper stay 29, a male connector 41 is protruded and, when the apparatus main body 2 is placed on the sheet feeding device 3, the male connector 41 can be fitted to the female connector 17.

As shown in FIG. 3 and other figure, in the left upper stay 30, a positioning pin attachment part 42 is formed at a position corresponding to the left positioning hole 10 of the apparatus main body 2. The positioning pin attachment part 42 is configured so that a circular upper penetration hole 44 is formed in a bottom face of a depression 43 having a tapered-bottom. To the positioning pin attachment part 42, a left positioning pin 60 is attached. The left positioning pin 60 will be described below in detail.

In the left upper stay 30, stand rubber holding holes 45 and 46 are formed to respectively arrange adjacent to the front and back of the positioning pin attachment part 42. The stand rubber holding holes 45 and 46 are located at distances from the left front support pole 26 and left back support pole 27. The stand rubber holding holes 45 and 46 are formed in a circular shape being able to hold the column part 18 of the left stand rubbers 14 and 15 of the apparatus main body 2 so that the thin plates 19 of the stand rubbers 14 and 15 come into contact with the exterior side edges of the stand rubber holding holes 45 and 46 in the left upper stay 30.

As shown in FIG. 3, on the right upper stay 31, a right positioning pin 47 is protruded at a position corresponding to the right positioning hole 11 of the apparatus main body 2. The right positioning pin 47 is formed so as to have an upward-protruded length longer than an upward-protruded length of the male connector 41. On the right upper stay 31, a notch 48 s formed at a position corresponding to the conveying port 16 of the apparatus main body 2 and stand rubber holding holes 50 and 51 are respectively formed in front and behind the notch 48.

The stand rubber holding holes 50 and 51 are located at positions corresponding to top ends of the right front support pole and right back support pole (not shown). The stand rubber holding holes 50 and 51 are formed in a circular shape being able to hold the column part 18 of the right stand rubbers 12 and 13 of the apparatus main body 2 so that the thin plates 19 of the stand rubbers 12 and 13 come into contact with the notch 48 side edges of the stand rubber holding holes 50 and 51 in the right upper stay 31.

Figure 4:
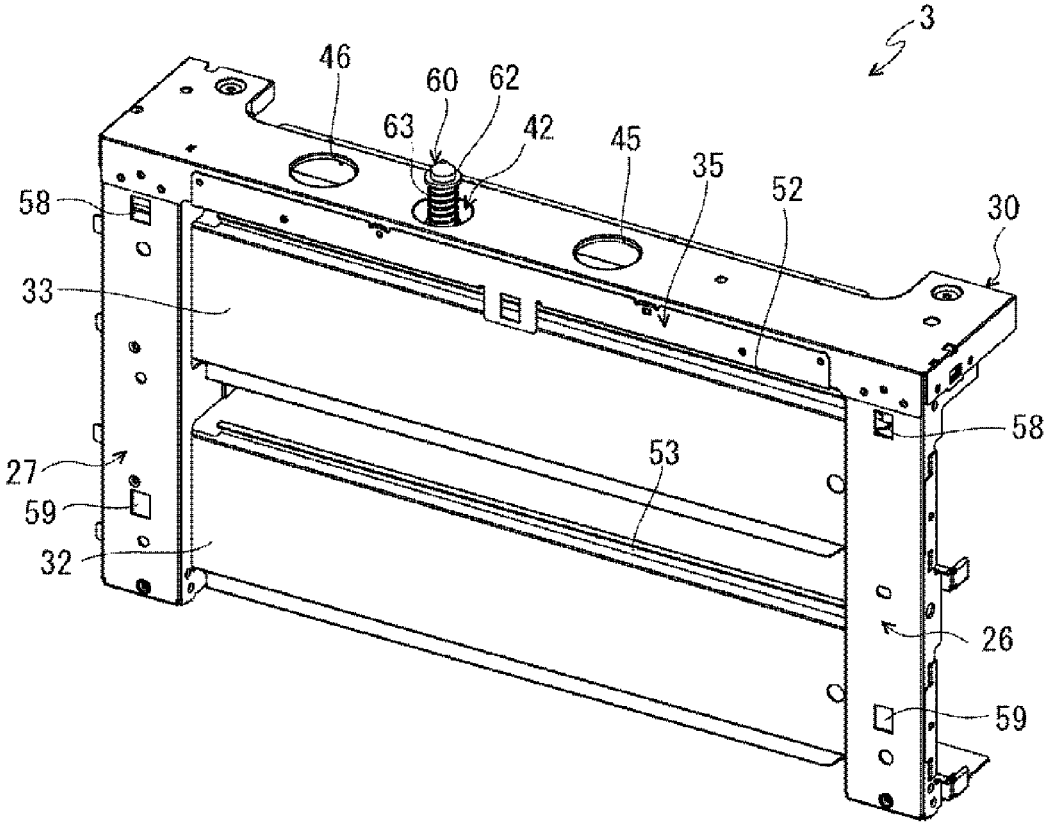
FIG. 4 is a perspective view showing a left side part of the sheet feeding device of the image forming apparatus according to the embodiment of the present disclosure.
Figure 5:
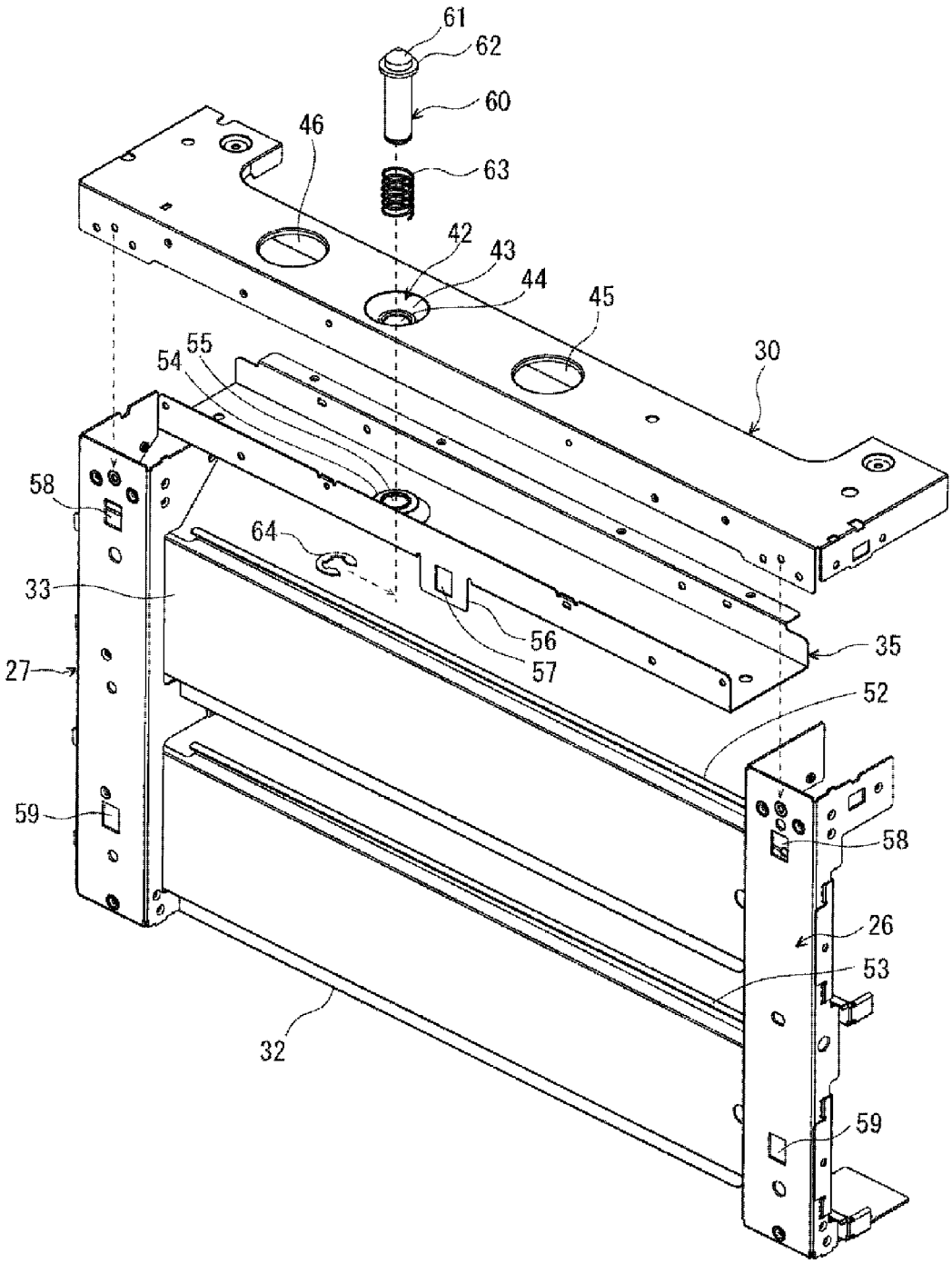
FIG. 5 is an exploded perspective view showing a left side part of the sheet feeding device of the image forming apparatus according to the embodiment of the present disclosure.
Figure 6:
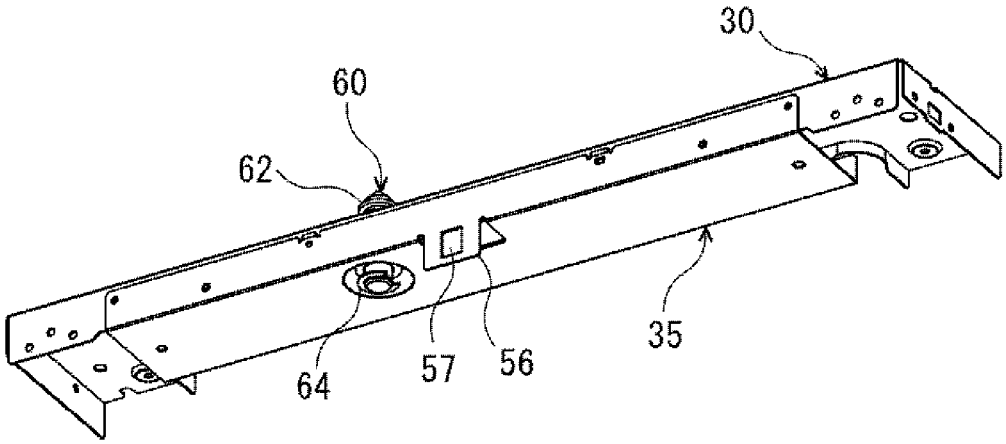
FIG. 6 is a bottom perspective view showing a left upper stay and a reinforcing plate of the sheet feeding device of the image forming apparatus according to the embodiment of the present disclosure.

As shown in FIGS. 4 and 5 and other figure, the left intermediate stay 33 and left lower stay 32 are formed in a horizontally long side plate-liked shape to function as slide rails together with the not-shown right intermediate stay and right lower stay when the upper and lower sheet feeding cartridges 22 and 23 are inserted or pulled out. In top ends of the left intermediate stay 33 and left lower stay 32, turned edges 52 and 53 are formed by bending with a U-shape section, thereby having high rigidity.

The left upper stay reinforcing plate 35 is formed in a gutter-liked shape and, in a position of the plate corresponding to the depression 43 of the positioning pin attachment part 42, a protuberance 54 with a trapezoid-liked section is formed. In the top of the protuberance 54, a circular lower penetration hole 55 is formed at a position planar-matching with the upper penetration hole 44.

In a center part of an outside face of the left upper stay reinforcing plate 35, an engaged piece 56 is formed to extend downward and, in the engaged piece 56, a rectangle hole 57 is formed. In respective upper and lower ends of outside faces of the left front support pole 26 and left back support pole 27, rectangle holes 58 and 59 are formed. Engaging parts (not shown) formed in an inside face of the cover panel 25 are stopped in engaged states in the rectangle holes 57, 58 and 59, thereby attaching the cover panels 25 to the frame 24.

Next, the left positioning pin 60 will be described in detail mainly with reference to FIGS. 5 and 8A to 10B.

The left positioning pin 60 is formed in a columnar shape being able to penetrate in the upper penetration hole 44 and lower penetration hole 55. A top end part 61 of the left positioning pin 60 is formed in a conical shape so as to facilitate fitting in the right positioning hole 11. In an upper part of the left positioning pin 60, a guard part 62 is formed slightly below the top end part 61 and the guard part 62 can come into contact with an edge of the left positioning hole 10.

Along the left positioning pin 60, a spring 63 is attached between the guard part 62 and a bottom face of depression 43 of the left upper stay 30 and the spring 63 biases the left positioning pin 60 upward.

A lower part of the left positioning pin 60 is formed so as to enable to come into contact with the turned edge 52 of the left intermediate stay 33. To the lower part of the left positioning pin 60, a stop ring 64 with a roughly C-shape is attached as an anti-falling part and the stop ring 64 is formed to have an outer diameter larger than the upper penetration hole 44 and lower penetration hole 55.

Figure 8B:
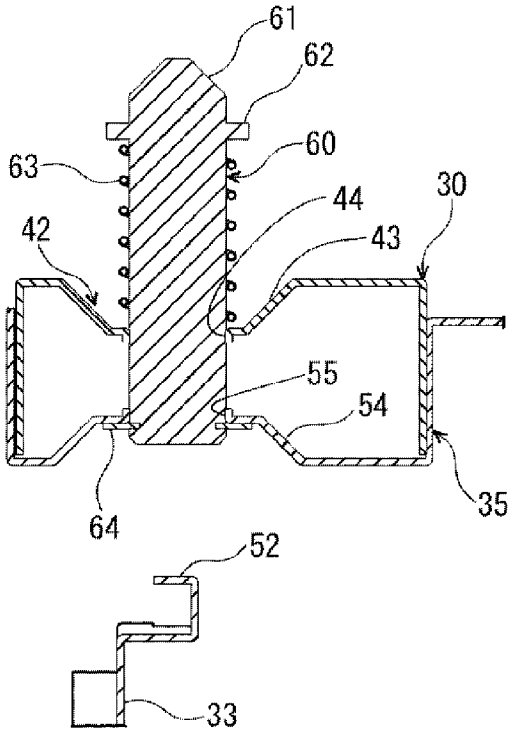
FIGS. 8A and 8B schematically shows a condition of a positioning pin, before the apparatus main body is placed on the sheet feeding device, in the image forming apparatus according to the embodiment of the present disclosure. Particularly.
Figure 8A:
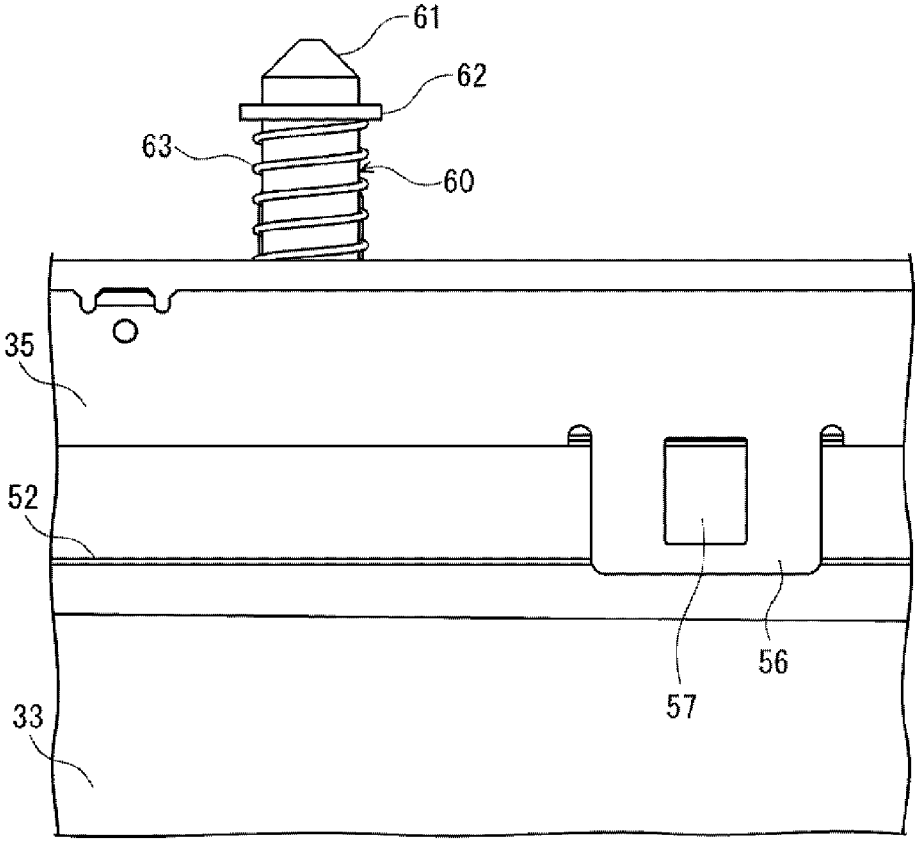

Thereby, in a case where the apparatus main body 2 is not placed on the sheet feeding device 3, as shown in FIGS. 8A and 8B, the left positioning pin 60 is configured to keep a condition protruding upward by the spring 63 and stop ring 64 so that the protruding length from a top face of the left upper stay 30 becomes longer than a protruding length of the male connector 41.

Figure 12:
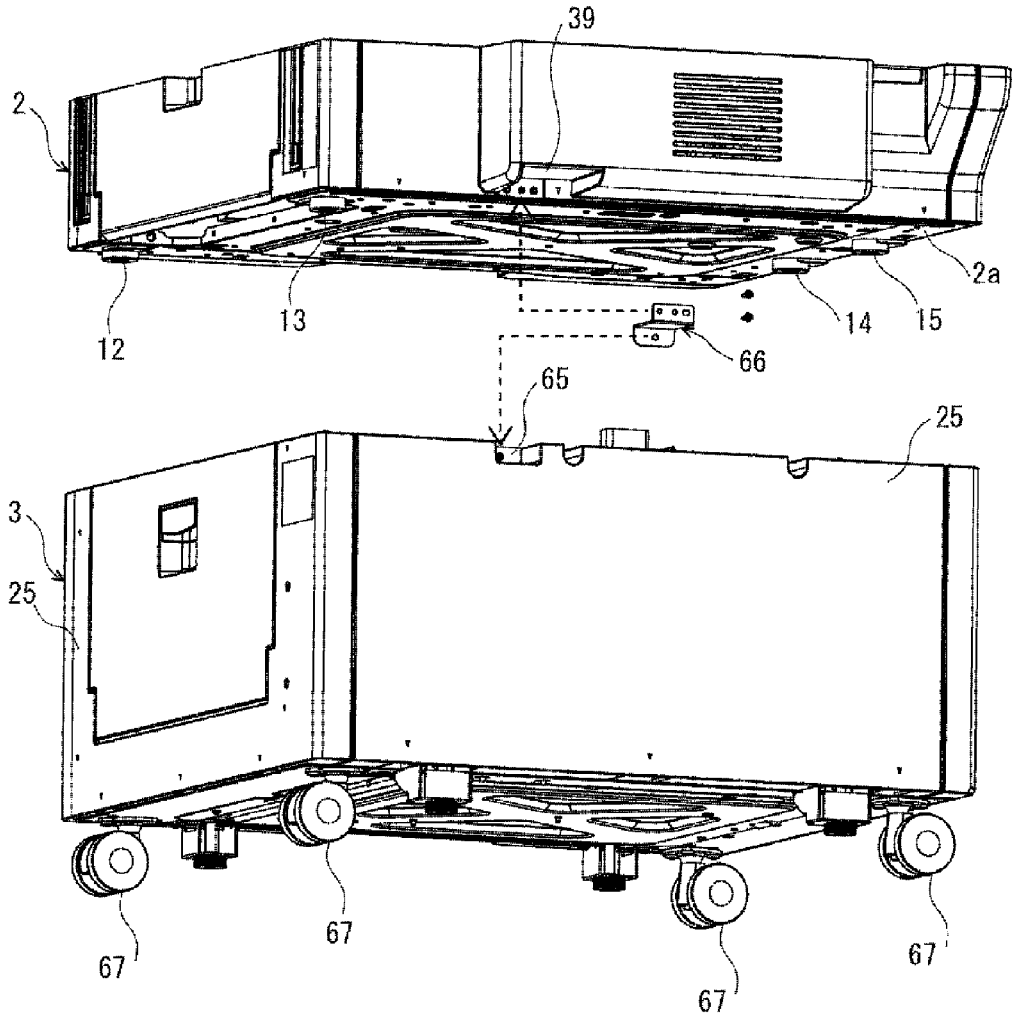
FIG. 12 is an exploded perspective view showing the image forming apparatus, in order to explain a manner of fixing the apparatus main body and sheet feeding device, according to the embodiment of the present disclosure.

Moreover, as shown in FIG. 12, in the sheet feeding device 3, a fixing depression 65 is formed at a right back position of the male connector 41 corresponding to the fixing depression 39 at a side of the apparatus main body 2 and a fixing plate 66 is fixed to the fixing depression 39 and fixing depression 65.

Next, the operation of placing the apparatus main body 2 on the sheet feeding device 3 in the image forming apparatus 1 according to the embodiment of the present disclosure will be described mainly with reference to FIGS. 7A to 12.

FIGS. 8A and 8B shows a condition of the positioning pin 60, before the apparatus main body 2 is placed on the sheet feeding device 3. Then, the left positioning pin 60 biased upward by the spring 63 and the stop ring 64 is stopped in an engaged state with an edge of the lower penetration hole 55 of the protuberance 54, thereby keeping the pin in the upward protruded condition.

Figure 7A:
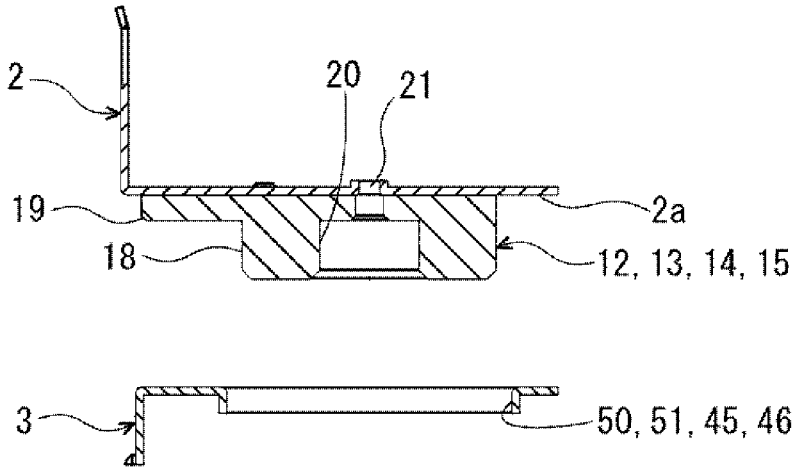
FIGS. 7A and 7B are sectional side views showing the stand rubber, when the apparatus main body is placed on the sheet feeding device, in the image forming apparatus according to the embodiment of the present disclosure. Particularly.
Figure 9B:
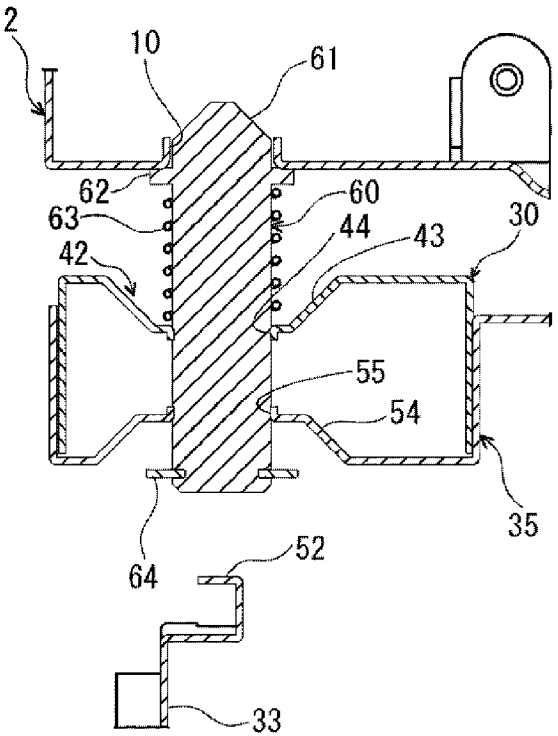
FIGS. 9A and 9B schematically shows another condition of the positioning pin, while the apparatus main body is placed on the sheet feeding device, in the image forming apparatus according to the embodiment of the present disclosure. Particularly.
Figure 9A:
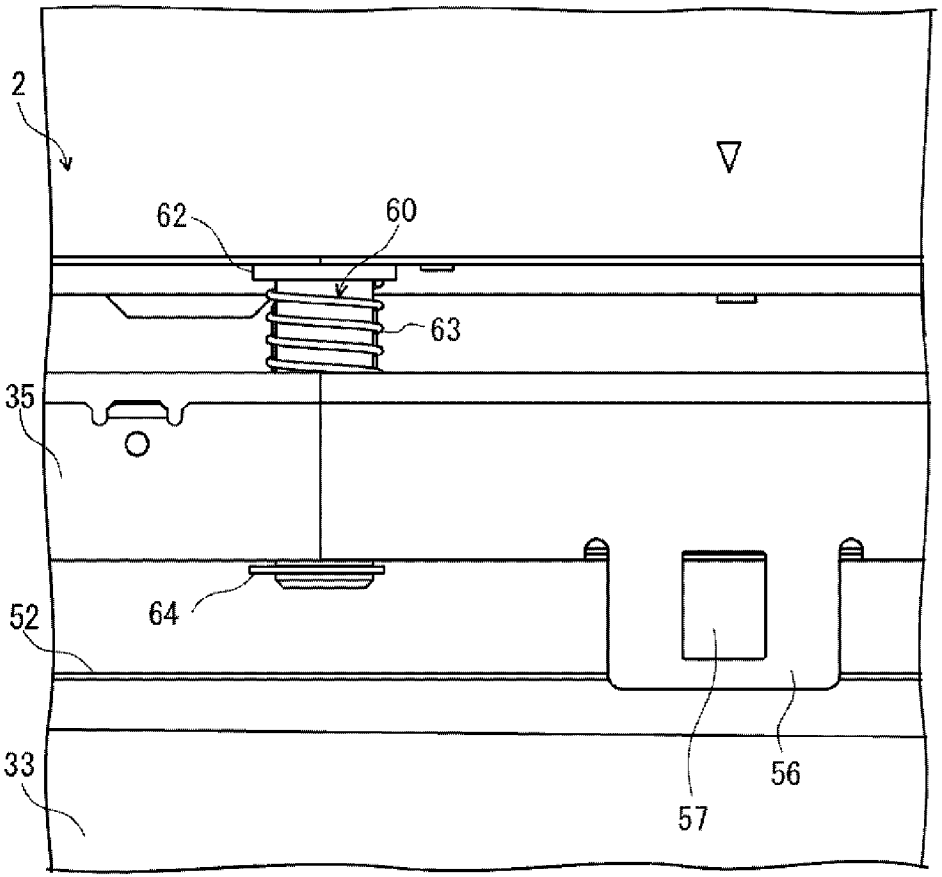

In order to place the apparatus main body 2 on the sheet feeding device 3, first, as shown in FIGS. 9A and 9B, the upper part of the left positioning pin 60 is fitted in the left positioning hole 10 and an upper part of the right positioning pin 47 is fitted in the right positioning hole 11. Thereby, the apparatus main body 2 is positioned to the sheet feeding device 3, and moreover, as shown in FIG. 7A, the column parts 18 of the stand rubber 12, 13, 14 and 15 are positioned above the stand rubber holding holes 50, 51, 45 and 46.

Figure 10B:
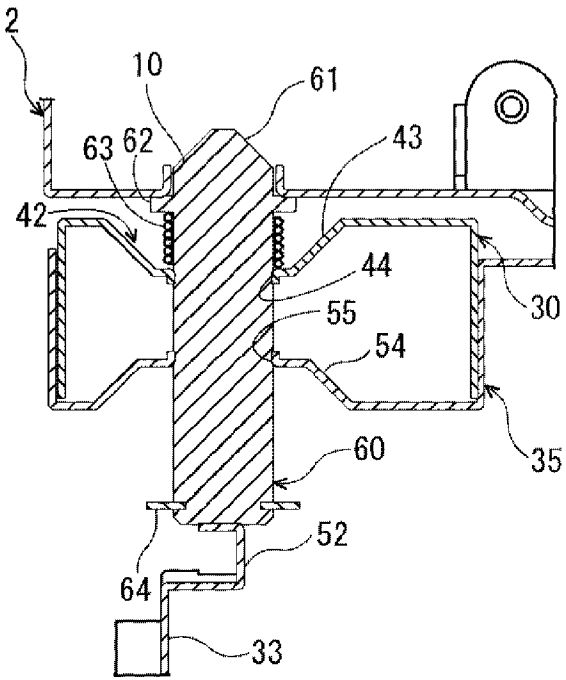
FIGS. 10A and 10B schematically shows a further condition of the positioning pin, after the apparatus main body is placed on the sheet feeding device, in the image forming apparatus according to the embodiment of the present disclosure. Particularly.
Figure 10A:
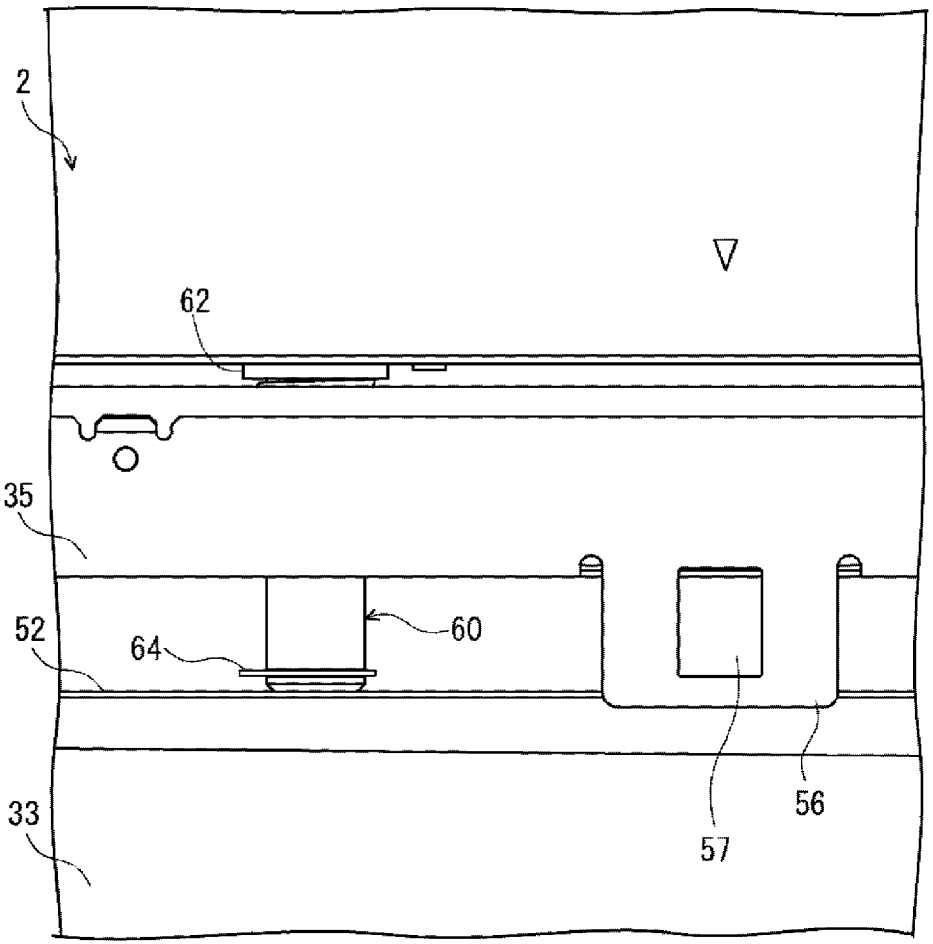

Subsequently to such a positioned condition, when the apparatus main body 2 is placed on the sheet feeding device 3, as shown in FIGS. 10A and 10B, the guard part 62 comes into contact with the edge of the left positioning hole 10. Thereby, the left positioning pin 60 is pushed downward against a biasing force of the spring 63, the lower part of the left positioning pin 60 comes into contact with the turned edge 52 of the left intermediate stay 33 and the right positioning pin 47 is deeply fitted in the right positioning hole 11.

Figure 7B:
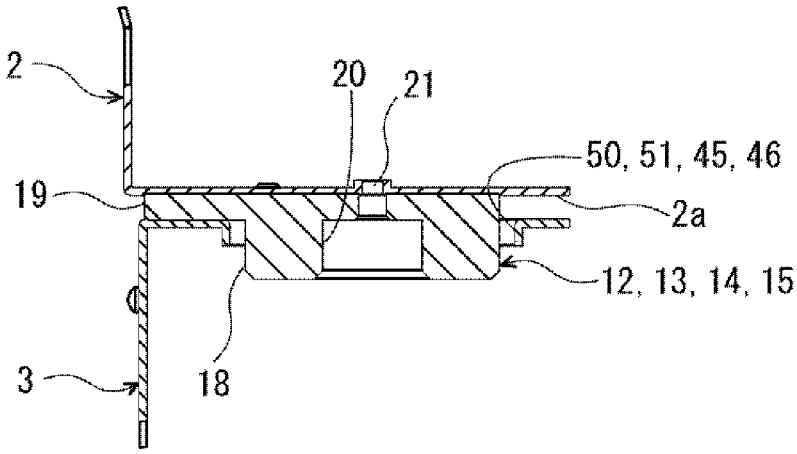

And then, the column parts 18 of the stand rubber 12, 13, 14 and 15 are, as shown in FIG. 7B, fitted in the stand rubber holding holes 50, 51, 45 and 46. In addition, the thin plates 19 of the right stand rubbers 12 and 13 come into contact with the notch 48 side edges of the stand rubber holding holes 50 and 51 in the right upper stay 31 and the thin plates 19 of the left stand rubbers 14 and 15 come into contact with the exterior side edges of the stand rubber holding holes 45 and 46 in the left upper stay 30.

Figure 11:
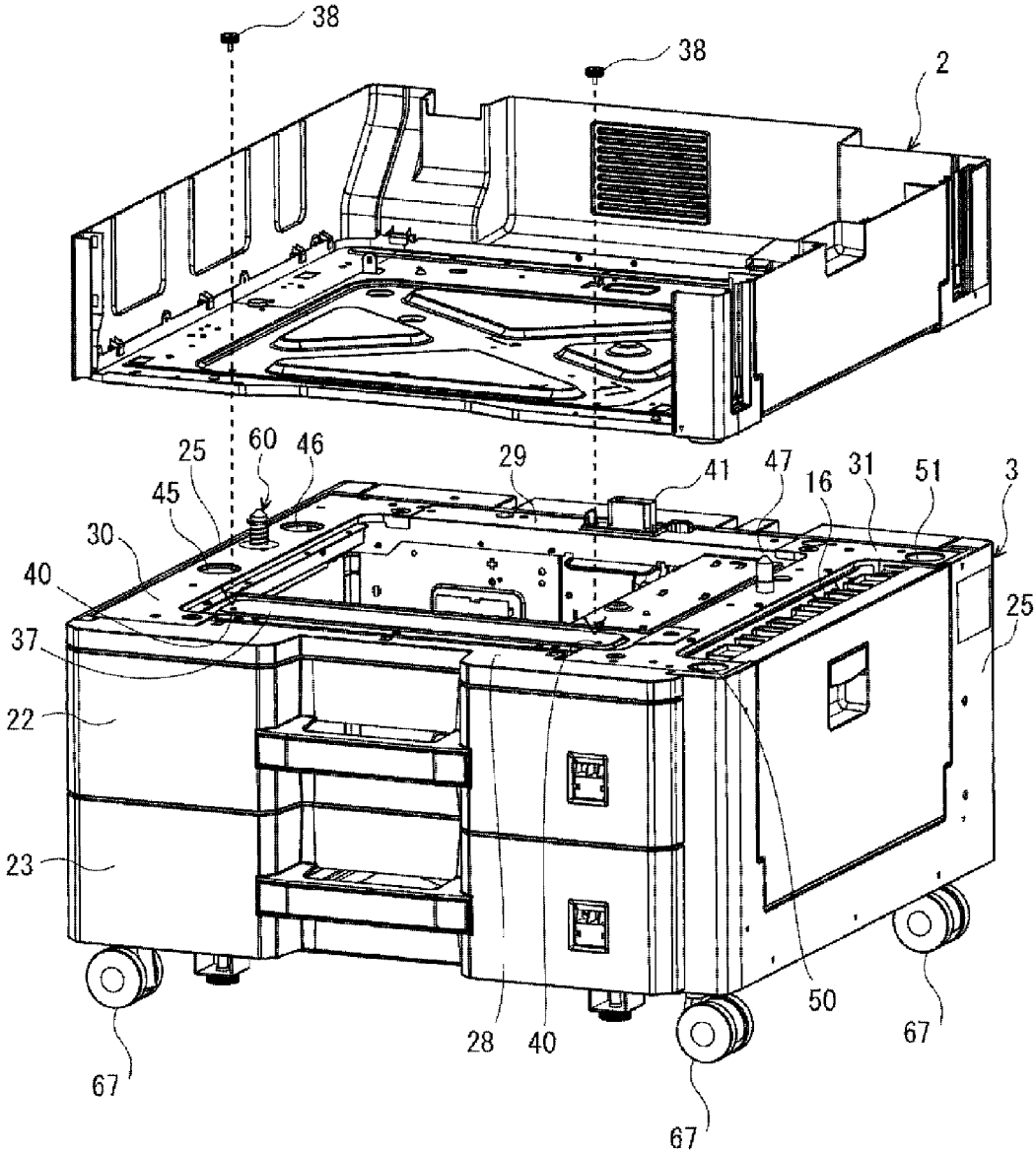
FIG. 11 is an exploded perspective view showing the image forming apparatus, in order to explain a manner of fixing the apparatus main body and sheet feeding device, according to the embodiment of the present disclosure.

Next, as shown in FIG. 11, the fixing screws 38 are respectively screwed in the screw holes 40 at the left and right sides of the fixing plate 37. In addition, as shown in FIG. 12, to the fixing depression 39 of the apparatus main body 2 and fixing depression 65 of the sheet feeding device 3, the fixing plate 66 is fixed by screws or the like. Accordingly, the apparatus main body 2 is fixed on the sheet feeding device 3.

In the above-mentioned image forming apparatus 1 according to the embodiment of the present disclosure, the top end parts of the left and right positioning pins 60 and 47 are formed in a conical shape and the upward protruding lengths of the left and right positioning pins 60 and 47 are longer than an upward protruding length of the male connector 41. Accordingly, it is possible to smoothly and surely position the apparatus main body 2 to the sheet feeding device 3. Therefore, it is possible to smoothly and surely fit the male connector 41 in the female connector 17 and fit the stand rubbers 12, 13, 14 and 15 in the stand rubber holding holes 50, 51, 45 and 46.

As the above-mentioned image forming apparatus 1 of the embodiment, in a case of applying a configuration that the apparatus main body 2 is supported on the sheet feeding device 3 by the three point mounting, the thin plates 19 of the left stand rubbers 14 and 15 come into contact with the left upper stay 30 near the center in comparison with the left front support pole 26 and left back support pole 27. In a well-known configuration, it is fear that the left upper stay is deformed by a load of the apparatus main body. By contrast, in the disclosure's configuration, the left positioning pin 60 works to position the apparatus main body 2 to the sheet feeding device 3 in a process of placing the apparatus main body 2 on the sheet feeding device 3 and to disperse the load of the apparatus main body 2 acting the left upper stay 30 to the left intermediate stay 33. Therefore, in accordance with the disclosure's configuration, it is possible to prevent the left upper stay 30 from deforming and to strengthen rigidity of the sheet feeding device 3.

Namely, in accordance with the disclosure, by providing the positioning pin, it is possible to position the apparatus main body to the sheet feeding device and to disperse the load of the apparatus main body to the mounting members and reinforcement members, thereby preventing the mounting members from deforming. Thus, it is possible to restrain a bend of the sheet feeding device, thereby coincidently actualizing an improvement of positioning accuracy and an improvement of rigidity of the sheet feeding device.

In addition, by providing the positioning pin with the spring between the mounting member and guard part to bias the positioning pin upward, it is possible to minimize the length of the positioning pin, thereby decreasing a manufacturing cost.

Moreover, by providing the positioning pin with the anti-falling part having the larger diameter than the hole of the mounting member penetrated by the positioning pin, it is possible to prevent the positioning pin from falling during conveyance of the sheet feeding device.

Furthermore, the sheet feeding device is provided with a plurality of the support poles connected with each other by the mounting members and reinforcement members. The lower face of the apparatus main body is provided with a plurality of the feet coming into contact with the mounting members when the apparatus main body is placed on the sheet feeding device. And then, at least one of these feet is located at a position shifted from another position facing to the support pole on the lower face of the apparatus main body and the positioning pin is located at a position adjacent to the at least one of the feet. Accordingly, it is possible to reinforce a part of the sheet feeding device easily bent by the load of the apparatus main body, thereby to actualize improvement of durability.

Although the above-mentioned embodiment is configured to arrange the spring 63 along the left positioning pin 60, this spring 63 is not an essential component for the disclosure. For example, the left positioning pin 60 may be formed longer than the embodiment so that the lower end always comes into contact with the left intermediate stay 33, thereby omitting the spring 63.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. A sheet feeding device comprising:

a structure as an option, on which an apparatus main body of an image forming apparatus having a lower face with a positioning depression is placed, configured to include:

a mounting member located to face to a periphery of the lower face of the apparatus main body;

a reinforcement member located below the mounting member; and a positioning pin configured to include an upper part having a guard part and a lower part and to penetrate the mounting member so that the upper part can fit in the positioning depression and the lower part can come into contact with the reinforcement member, wherein the positioning pin is provided with a spring between the mounting member and guard part to bias the positioning pin upward, and when the apparatus main body is placed, in the positioning pin, the upper part fits in the positioning depression, the guard part comes into contact with an edge of the positioning depression and the lower part comes into contact with the reinforcement member.

2. The sheet feeding device according to claim 1, wherein the positioning pin is provided with an anti-falling part having the larger diameter than a hole of the mounting member penetrated by the positioning pin.

3. The sheet feeding device according to claim 1, moreover comprising:

a plurality of the support poles connected with each other by the mounting member and reinforcement member, wherein the mounting member comes into contact with a plurality of the feet arranged on the lower face of the apparatus main body, when the apparatus main body is placed on, so that at least one of the feet is located at a position shifted from another position facing to the support pole on the lower face of the apparatus main body, and the positioning pin is located at a position adjacent to the at least one of the feet.

4. The sheet feeding device according to claim 1, further comprising:

at least one sheet feeding cartridge to be pulled out, wherein the mounting member and reinforcement member work as a slide rails, when the sheet feeding cartridge is inserted or pulled out.

5. An image forming apparatus comprising:

an apparatus main body having a lower face with a positioning depression; and a sheet feeding device as an option on which the apparatus main body is placed;

wherein the sheet feeding device including:

a mounting member located to face to a periphery of the lower face of the apparatus main body;

a reinforcement member located below the mounting member; and a positioning pin configured to include an upper part having a guard part and a lower part and to penetrate the mounting member so that the upper part can fit in the positioning depression and the lower part can come into contact with the reinforcement member, wherein the positioning pin is provided with a spring between the mounting member and guard part to bias the positioning pin upward, and when the apparatus main body is placed, in the positioning pin, the upper part fits in the positioning depression, the guard part comes into contact with an edge of the positioning depression and the lower part comes into contact with the reinforcement member.

6. The image forming apparatus according to claim 5, wherein the positioning pin is provided with an anti-falling part having the larger diameter than a hole of the mounting member penetrated by the positioning pin.

7. The image forming apparatus according to claim 5, wherein the sheet feeding device includes a plurality of the support poles connected with each other by the mounting member and reinforcement member, the mounting member comes into contact with a plurality of the feet arranged on the lower face of the apparatus main body, when the apparatus main body is placed on, so that at least one of the feet is located at a position shifted from another position facing to the support pole on the lower face of the apparatus main body, and the positioning pin is located at a position adjacent to the at least one of the feet.

8. The image forming apparatus according to claim 5, wherein the sheet feeding device is configured install at least one sheet feeding cartridge to be pulled out, and the mounting member and reinforcement member work as a slide rails, when the sheet feeding cartridge is inserted or pulled out.

* * * * *